US010364657B2

(12) United States Patent
Mason et al.

(10) Patent No.: US 10,364,657 B2
(45) Date of Patent: Jul. 30, 2019

(54) COMPOSITE DRILL GUN

(71) Applicant: Halliburton Energy Services, Inc., Houston, TX (US)

(72) Inventors: Justin Lee Mason, Denton, TX (US); Blake Lyndon Arabie, Lafayette, LA (US); Dirk James Punch, Marrero, LA (US); Raymond Dane Newman, Lafayette, LA (US); Jack Phillip Tourres, III, Kenner, LA (US); David Francis Suire, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/554,600

(22) PCT Filed: Apr. 17, 2015

(86) PCT No.: PCT/US2015/026372

§ 371 (c)(1),
(2) Date: Aug. 30, 2017

(87) PCT Pub. No.: WO2016/167794

PCT Pub. Date: Oct. 20, 2016

(65) Prior Publication Data

US 2018/0045026 A1 Feb. 15, 2018

(51) Int. Cl.
*E21B 43/00* (2006.01)
*F42D 1/04* (2006.01)
(Continued)

(52) U.S. Cl.
CPC ..... *E21B 43/11852* (2013.01); *E21B 43/116* (2013.01); *F42D 1/04* (2013.01); *F42D 1/22* (2013.01)

(58) Field of Classification Search
CPC ..... E21B 43/116; F42D 1/04
(Continued)

(56) References Cited

U.S. PATENT DOCUMENTS 4,531,583 A 7/1985 Revett et al.
4,605,074 A 8/1986 Barfield et al.
(Continued)

OTHER PUBLICATIONS

International Patent Application No. PCT/US2015/026372 , "International Search Report and Written Opinion", dated Dec. 10, 2015, 14 pages.

(Continued)

*Primary Examiner* — Taras P Bemko
(74) *Attorney, Agent, or Firm* — Kilpatrick Townsend & Stockton LLP

(57) ABSTRACT

A composite drill gun for use in a wellbore environment can include a detonation housing containing a detonation source, a composite carrier containing one or more encapsulated charges, and a detonation train connecting the detonation source to the encapsulated charges. The detonation source and each individual encapsulated charge are all sealed with respect to the wellbore environment, and thus the carrier need not be sealed with respect to the wellbore environment. The carrier can be made out of composite materials without worry of leaks into the interior of the carrier, as the detonation source and encapsulated charges are all sealed with respect to the wellbore environment. The composite carrier can be easily drilled out of the wellbore after detonation.

19 Claims, 5 Drawing Sheets

(51) Int. Cl.
*E21B 43/1185* (2006.01)
*E21B 43/116* (2006.01)
*F42D 1/22* (2006.01)

(58) Field of Classification Search
USPC ..... 175/4.56
See application file for complete search history.

(56) References Cited

U.S. PATENT DOCUMENTS 5,107,929 A 4/1992 Cardenas
5,390,742 A 2/1995 Dines et al.
5,542,480 A 8/1996 Owen et al.
5,623,993 A 4/1997 Van Buskirk et al.
5,680,905 A 10/1997 Green et al.
6,062,310 A 5/2000 Wesson et al.
6,595,289 B2 7/2003 Tumlin et al.
6,880,637 B2 4/2005 Myers, Jr. et al.
7,208,855 B1 * 4/2007 Floyd ..... E21B 43/128 166/66.4
7,409,990 B1 8/2008 Burts, Jr. et al.
7,735,578 B2 6/2010 Loehr et al.
7,913,761 B2 3/2011 Pratt et al.
7,975,592 B2 7/2011 Bell et al.
7,984,761 B2 7/2011 Chang et al.
8,272,447 B2 9/2012 Lee et al.
8,469,087 B2 6/2013 Gray et al.
8,622,132 B2 1/2014 Coffey et al.
2003/0047313 A1 3/2003 Wehunt, Jr. et al.
2008/0073081 A1 * 3/2008 Frazier ..... E21B 43/11 166/280.1
2009/0183916 A1 7/2009 Pratt et al.
2013/0062062 A1 3/2013 Petty et al.
2013/0118805 A1 5/2013 Moody-Stuart et al.
2013/0240207 A1 9/2013 Frazier et al.
2014/0034384 A1 2/2014 Fadul et al.
2015/0041135 A1 * 2/2015 Coffey ..... E21B 43/11852 166/297
2017/0226829 A1 * 8/2017 Segura ..... E21B 43/11855

OTHER PUBLICATIONS

Perforating Systems Manual , “Drillable Perforating Guns”, Aug. 2013, 45 pages.

* cited by examiner

COMPOSITE DRILL GUN

CROSS-REFERENCE TO RELATED APPLICATIONS

This is a U.S. national phase under 35 U.S.C. 371 of International Patent Application No. PCT/US2015/026372, titled "Composite Drill Gun" and filed Apr. 17, 2015, the entirety of which is incorporated herein by reference.

TECHNICAL FIELD

The present disclosure relates to oilfield operations generally and more specifically to drill guns.

BACKGROUND

In oilfield operations, drill guns can be used to provide directed detonations into a wellbore at specified locations within a wellbore. Drill guns can be used during squeeze applications, formation testing applications, or other applications where it is desirable to create perforations in the pipe or casing of a wellbore. Fractures in the formation surrounding the wellbore can be made using drill guns. Detonation of explosives downwell can also be used in a process of sealing a wellbore.

The drill gun can be placed downwell and triggered. Upon triggering, the drill gun can detonate its charges. Remnants of the drill gun can remain in the wellbore. In some applications, remnants of the drill gun may be encased in cement within the wellbore as the wellbore itself is cemented. Sometimes, it may be desirable to remove the drill gun remnants to make further use of the wellbore.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
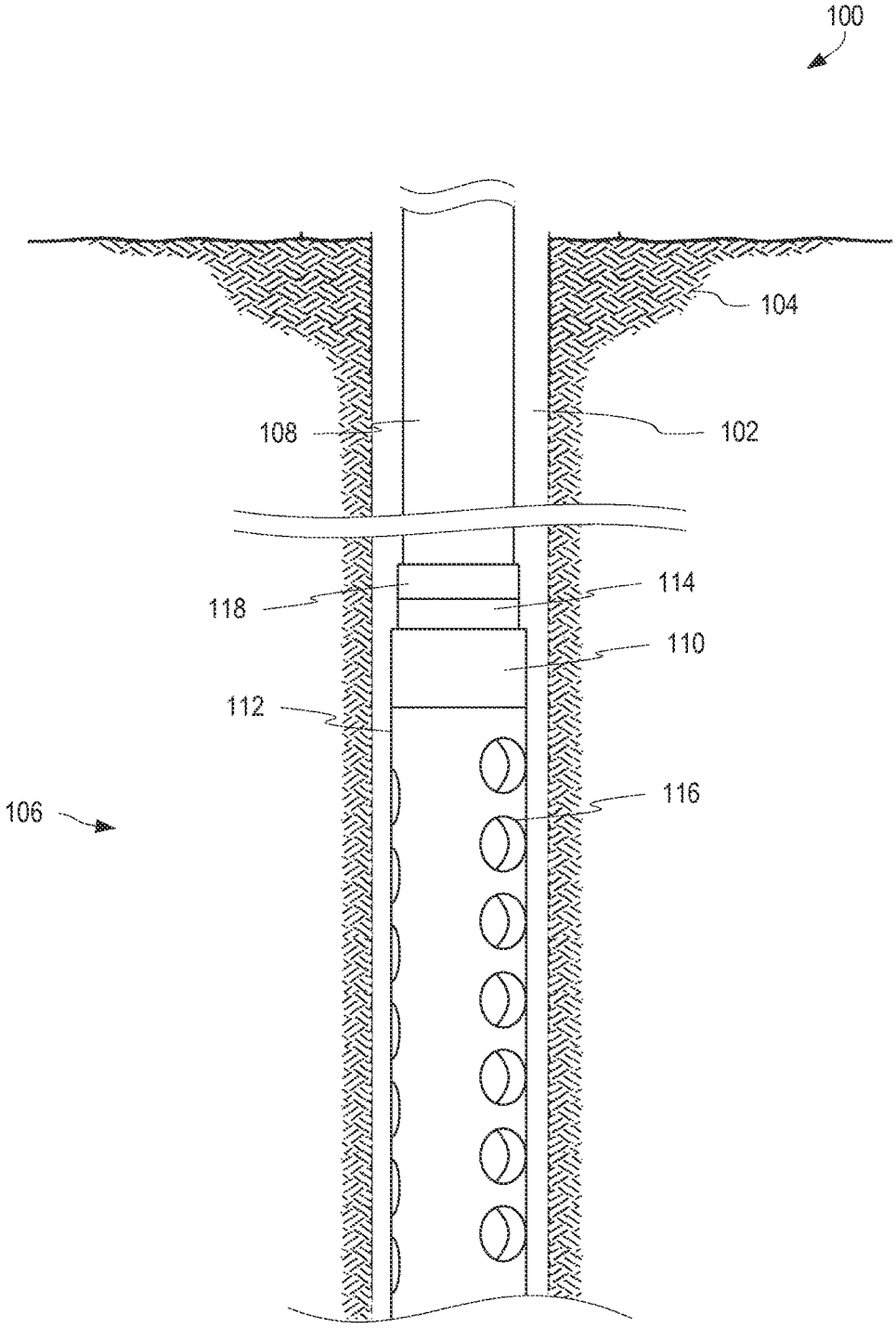
FIG. 1 is a schematic diagram of a wellbore including a drill gun according to certain aspects of the present disclosure.

Certain aspects and features of the present disclosure relate to a composite drill gun for use in a wellbore environment. The composite drill gun can include a detonation housing containing a detonation source, a composite carrier containing one or more encapsulated charges, and a detonation train connecting the detonation source to the encapsulated charges. The detonation source and each individual encapsulated charge can be sealed with respect to the wellbore environment, and the carrier does not need to be sealed with respect to the wellbore environment. The carrier can be made out of composite materials. There is no need to fluidly isolate the interior of the carrier, as the detonation source and encapsulated charges can be sealed with respect to the wellbore environment. The composite carrier can be easily drilled out of the wellbore after detonation.

In an example, a composite drill gun as described herein can be used with a composite squeeze retainer to perform a perforation and cement squeeze to temporarily abandon a well. The composite drill gun can allow deployment of the explosive charges inside a drillable carrier (e.g., a composite carrier) that can be attached to a threaded pipe. In another example, a composite drill gun as described herein can be used for formation evaluation applications where gauges can be run with the drill gun for purposes that include mini-frac treatment, obtaining formation pressure, and other purposes. A composite drill gun as described herein can be rated up to at least 5,000 pounds per square inch (PSI) and up to at least 250° F. Composite drill guns with ratings below or above 5,000 PSI and 250° F. can also be used.

In a composite drill gun as described herein, the use of composite materials for certain components can replace the use of more difficult-to-drill materials, such as cast-iron. The composite drill gun can enable communication with the wellbore formation, enable procedures, such as cement squeezing, and can then enable the easy removal of the assembly from the wellbore through drilling (e.g., where a drill is used to break up and remove the remnants of the composite drill gun).

In an example, a composite drill gun as described herein can be used during a production squeeze with remedial cementing. Operator and rig time can be saved by allowing the perforation and squeeze operations to be performed using a single trip downwell because the composite drill gun can be located on the same tubular providing the cement. As well, the use of the composite drill gun can enable a speedy drill-up procedure.

In another example, a composite drill gun as described herein can be used during a temporary or permanent abandonment procedure. If access to the wellbore is ever needed in the future, however, the composite drill gun can be more easily drilled-up than predecessor drill guns.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a schematic diagram of a wellbore 102 including a drill gun 106 according to certain aspects of the present disclosure. The wellbore 102 can penetrate a subterranean formation 104 for the purpose of recovering hydrocarbons, storing hydrocarbons, disposing of carbon dioxide, or the like. The wellbore 102 can be drilled into the subterranean formation 104 using any suitable drilling technique. While shown as extending vertically from the surface in FIG. 1, in other examples the wellbore 102 can be deviated, horizontal, or curved over at least some portions of the wellbore 102. Portions of the wellbore 102 can be cased, open hole, contain tubing, and can include a hole in the ground having a variety of shapes or geometries.

A service rig, such as a drilling rig, a completion rig, a workover rig, or other mast structure or combination thereof can support a workstring 108 in the wellbore 102, but in other examples a different structure can support the workstring 108. For example, an injector head of a coiled tubing rigup can support the workstring 108. In some aspects, a service rig can include a derrick with a rig floor through which the workstring 108 extends downward from the service rig into the wellbore 102. The servicing rig can be supported by piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, a casing may extend from the service rig to exclude sea water and contain drilling fluid returns. Other mechanical mechanisms that are not shown may control the run-in and withdrawal of the workstring 108 in the wellbore 102. Examples of these other mechanical mechanisms include a draw works coupled to a hoisting apparatus, a slickline unit or a wireline unit including a winching apparatus, another servicing vehicle, and a coiled tubing unit.

The workstring 108 can include a tubular attached to a drill gun 106. The drill gun 106 can include a detonation housing 110, a carrier 112, a piston housing 114, and a piston tubular 118. The carrier 112 can be made of a composite material that can be easily drilled-up. The carrier 112 can include one or more apertures 116. The apertures 116 can be spaced longitudinally down the length of the carrier 112, as well as spaced radially around the circumference of the carrier 112. The radial spacing can be offset by any number of degrees to create a multi-phase array of spacings (e.g., 120° apart for a three-phase array or 90° apart for a four-phase array). The carrier 112 can include an encapsulated charge adjacent each of the apertures 116. The interior of the carrier 112 may be fluidly open with respect to the surrounding environment of the wellbore 102, such as through apertures 116.

The detonation housing 110 can include a detonation source coupled to the encapsulated charges by a detonation train, such that detonation of the detonation source causes detonation of each of the encapsulated charges. The detonation source is fluidly isolated from the interior of the carrier 112 and the surrounding environment of the wellbore 102 to maintain the integrity and reliability of the detonation source.

In an embodiment, the workstring 108 carries a pressurized fluid to the piston tubular 118. When the pressurized fluid is sufficiently pressurized, a piston head of the piston tubular 118 can impact a firing piston rod of the piston housing 114, causing a firing pin to impact the detonation source in the detonation housing 110, causing detonation of the detonation source, and thus detonation of the encapsulated charges within the carrier 112.

Figure 2:
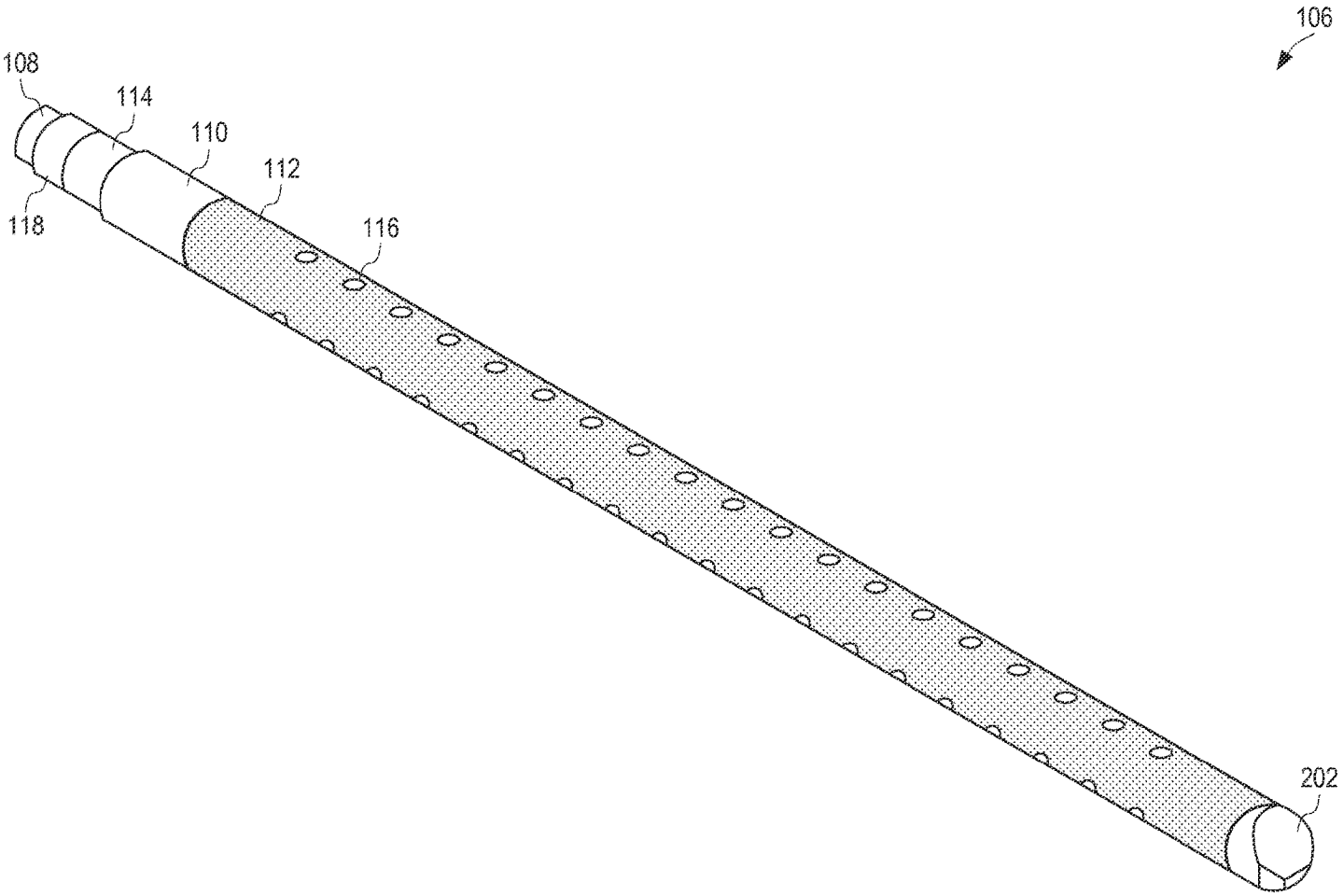
FIG. 2 is an isometric view of a drill gun according to certain aspects of the present disclosure.

FIG. 2 is an isometric view of the drill gun 106 of FIG. 1 according to certain aspects of the present disclosure. The carrier 112 can be made of a composite material, such as any composite material that is easily drilled-up. In some embodiments, the composite materials can include a fiber-reinforced polymers with any combination of glass, graphite, or other fibers. In some embodiments, the composite materials can include composite fibers which are molded or wound or wrapped with a resin system to bond the fibers together. Other composite materials can be used. A bull plug 202 can be coupled to the carrier 112 opposite the detonation housing 110. The bull plug 202 can be made of a composite material, such as the same or a different composite material than the carrier 112. The bull plug 202 can provide protection for the carrier 112 and the encapsulated charges within the carrier 112. The coupling between the bull plug 202 and the carrier 112 need not be fluidly sealed. In some embodiments, the detonation cord used within the carrier 112 can be terminated on the bull plug 202. The carrier 112 can include one or more apertures 116. In some embodiments, the carrier 112 may include no apertures 116.

The carrier 112 is coupled to the detonation housing 110 at an end of the carrier 112, such as at a top end. The detonation source within the detonation housing 110 is fluidly isolated from the interior of the carrier 112, and thus the surrounding wellbore environment. The detonation housing 110 is coupled to the workstring 108, such as through a piston housing 114 and piston tubular 118, although the detonation housing 110 can be coupled to the workstring 108 in other ways.

Figure 3:
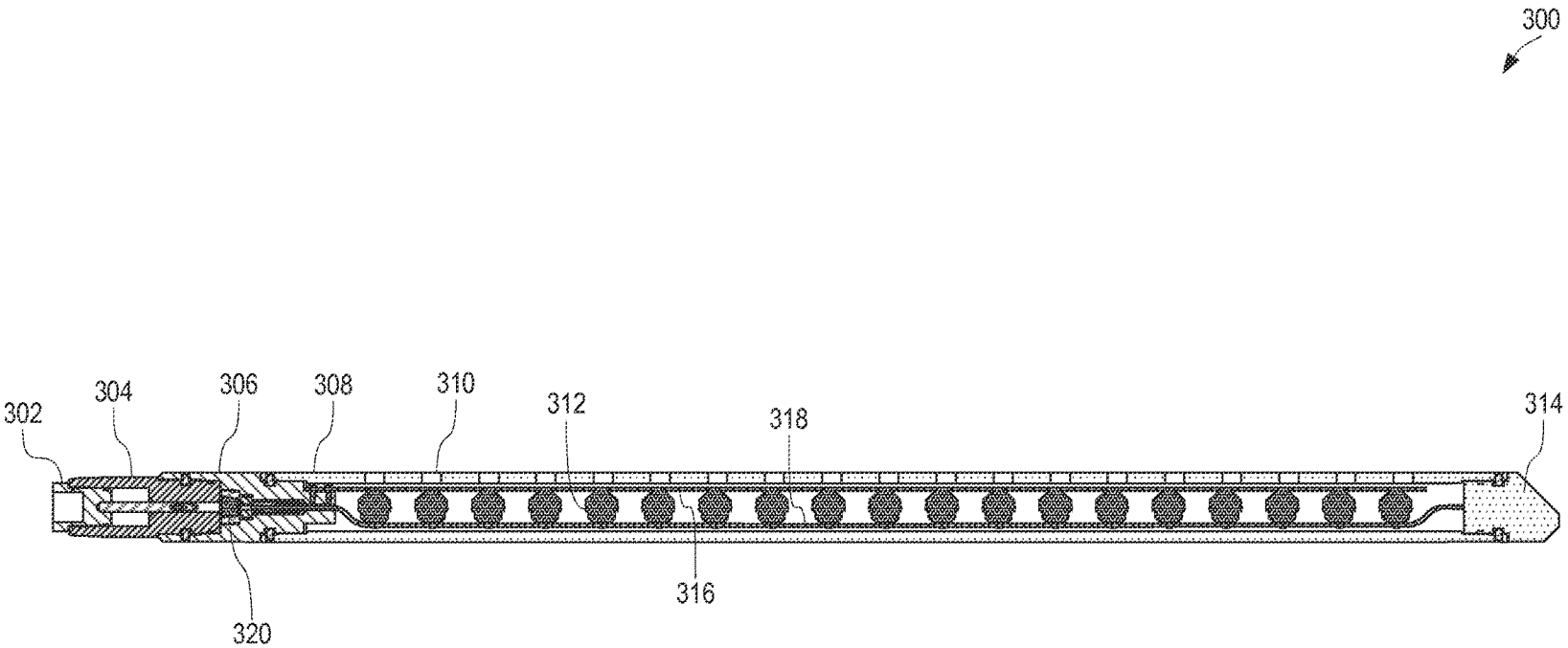
FIG. 3 is a cut-away view of a drill gun according to certain aspects of the present disclosure.

FIG. 3 is a cut-away view of a drill gun 300 according to certain aspects of the present disclosure. The drill gun 300 can include a carrier 308 having apertures 310. The carrier 308 is coupled to a detonation housing 306 having a detonation source 320. The detonation housing 306 can be coupled to a piston housing 304 and a piston tubular 118.

The detonation housing 306 includes a carrier strip 316. One or more encapsulated charges 312 can be coupled to the carrier strip 316. In some embodiments, each encapsulated charge 312 can be threadably coupled to the carrier strip 316. The carrier strip 316 extends through the carrier 112. Each encapsulated charge 312 can be supported by the carrier strip 316, with the encapsulated charge 312 positioned adjacent an aperture 310. In some embodiments, the encapsulated charge 312 can be a directional charge positioned to produce an explosion or detonation out through the aperture 310.

A detonation train couples the detonation source 320 to the encapsulated charges 312. In an embodiment, detonation of the detonation source 320 causes detonation of the detonation cord 318, such as directly or through an intermediary as described in further detail below. The detonation cord 318 can be coupled to each of the encapsulated charges 312, such as externally coupled to each of the encapsulated charges 312. Each encapsulated charge 312 can contain explosive materials designed to detonate in response to a close-proximity detonation of the detonation cord 318.

Figure 4:
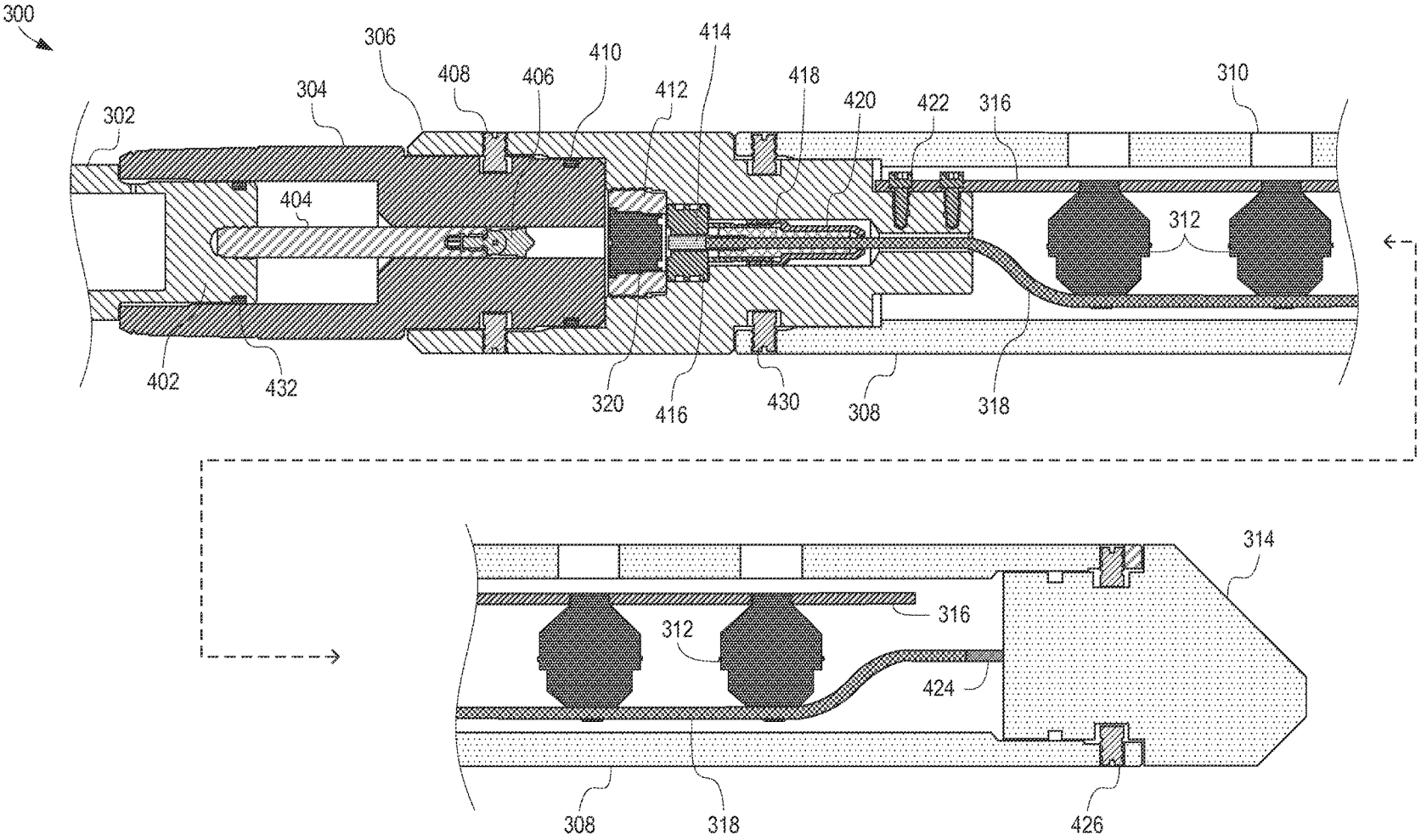
FIG. 4 is a partial cut-away view of the drill gun of FIG. 3 according to certain aspects of the present disclosure.

FIG. 4 is a partial cut-away view of the drill gun 300 of FIG. 3 according to certain aspects of the present disclosure. The carrier 308 can be coupled to a detonation housing 306, such as by set screws 430. The carrier 308 can be open to the surrounding environment (e.g., surrounding downhole environment).

The detonation housing 306 includes a detonation source 320 within an interior chamber of the detonation housing 306. The detonation source 320 can be any suitable source of a detonation, including a percussion detonator. The interior chamber of the detonation housing 306 is fluidly sealed with respect to the surrounding environment. The detonation source 320 can be held in place by a retention device 412. A booster 414 can be held in a booster retainer 416 adjacent the retention device 412. A detonation cord 318 can be coupled to the booster 414. In an embodiment, the booster 414 is crimped to the detonation cord 318.

The detonation source 320 can detonate upon being triggered, such as by being impacted by a firing pin 406 in the case of a percussion detonator. Detonating the detonation source 320 can cause detonation of the booster 414. The booster 414 can detonate, to cause the detonation cord 318 to detonate. The detonation cord 318 can detonate along its entire length, successively detonating each encapsulated charge 312 to which it is coupled. Each encapsulated charge 312 can include a charge encapsulated in steel or ceramic. Each encapsulated charge 312 can include primer at one end of the encapsulated charge 312 where the detonation cord 318 can be attached. The shock of the detonation cord 318 detonating in close proximity to the primer causes the primer to detonate, resulting in detonation of the charge in the encapsulated charge 312. Any suitable components for causing detonation of the encapsulated charges 312 in response to detonation of the detonation source 320 can be considered the detonation train. As shown in FIGS. 3-4, the detonation train comprises the booster 414 and the detonation cord 318.

The interior chamber of the detonation housing 306 must be fluidly isolated from the surrounding environment to keep the detonation source 320 and booster 414 fluidly isolated from the surrounding environment. At a top end, the detonation housing 306 can be sealed form the environment by the piston housing 304. The piston housing 304 can couple to the detonation housing 306 using set screws 408. Seals 410 and seals 432 fluidly isolate the interior of the detonation housing 306 from the environment. At a bottom end, the detonation cord 318 exits the detonation housing 306 through an opening. The detonation cord 318 passes through seal 420, which fluidly isolates the remainder of the interior of the detonation housing 306 from the surrounding environment. Seal 420 can be a compression seal. In some embodiments, seal 420 can include a rubber boot 418. In some embodiments, the seal 420 includes an outer portion that threadably engages the booster retainer 416 and compresses the rubber boot 418 about the detonation cord 318.

A carrier strip 316 can be coupled to the detonation housing 306 by fasteners 422 (e.g., screws). The encapsulated charges 312 can be coupled to the carrier strip 316. In some embodiments, the carrier strip 316 can be coupled to the carrier 308. In yet other embodiments the encapsulated charges 312 can be directly coupled to the carrier 308. The encapsulated charges 312 can be coupled to the carrier strip 316 at locations where each encapsulated charge 312 would be adjacent to and directed out of an aperture 310 of the carrier 308.

In embodiments where the detonation source 320 is a percussion detonator, the detonation source 320 can be triggered by a firing pin 406. The firing pin 406 can be retained within the piston housing 304 and coupled to a firing piston 402 by a piston rod 404. The firing piston 402 can be a distal end of the piston tubular 302. The firing piston 402 can include seals 432 to ensure the fluid isolation of the interior of the detonation housing 306. In some embodiments, the firing piston 402 and piston rod 404 can be made of a metal, such as brass (e.g., Unified Numbering System Alloy C36000), although other materials can be used. In some embodiments, the piston housing 304 can be made of a high-strength alloy, such as AMPCOLOY 45, although other materials can be used.

To fire the drill gun 300, strong pressure can build up in the piston tubular 302, such as through the use of pressurized fluid. Upon the generation of sufficient pressure, the piston head 402 can shear off the piston tubular 302, allowing the piston head 402 to quickly force the piston rod 404 and the connected firing pin 406 towards the detonation source 320. Upon contact by the firing pin 406 with the detonation source 320, the detonation source 320 can detonate.

At the distal end of the drill gun 300, a bull plug 314 can be coupled to the carrier 308, such as using set screws 426. In some embodiments, the detonation cord 318 can additionally be coupled to the bull plug 314 by a termination 424. The bull plug 314 can be made of a composite material, such as the same composite material as the carrier 308.

The drill gun as described herein can be used on the end of a tubular and can be triggered by pressurized fluid, such as air, water, or other fluid. The drill gun can use composite materials as described herein, such as composite materials capable of being easily drilled-up (e.g., removed from the wellbore after detonation using a drilling apparatus). In some embodiments, only the carrier 308 is made of a composite material. In other embodiments, the carrier 308 and any combination of the detonation housing 306, the piston housing 304, bull plug 314, and the piston tubular 302 can be made of a composite material.

The drill gun 300 can include a single encapsulated charge 312 or many encapsulated charges 312. The drill gun 300 can include encapsulated charges 312 arranged in a single line, or arranged in one or more lines spaced rotationally from one another. The carrier 308 can include an aperture 310 for each encapsulated charge 312, an aperture 310 for two or more encapsulated charges 312, or no apertures 310.

The drill gun 300 can contain a detonation source 320, encapsulated charges 312, and a detonation train (e.g., including a booster 414 and a detonation cord 318). In an embodiment, each of these components is capable of generating a detonation. In other embodiments, one or some of these components may create an explosion or deflagration.

The drill gun as described herein can provide a composite carrier without the need to fluidly seal the interior of the carrier from the surrounding environment. Rather, the detonation housing can fluidly sealed from the surrounding environment. The fluid seal of the detonation housing can be a pressure seal, allowing the detonation housing to maintain its pressure seal for a significant amount of time. In some embodiments, the detonation housing can maintain its pressure seal for at least approximately 12 hours in a downhole environment.

Figure 5:
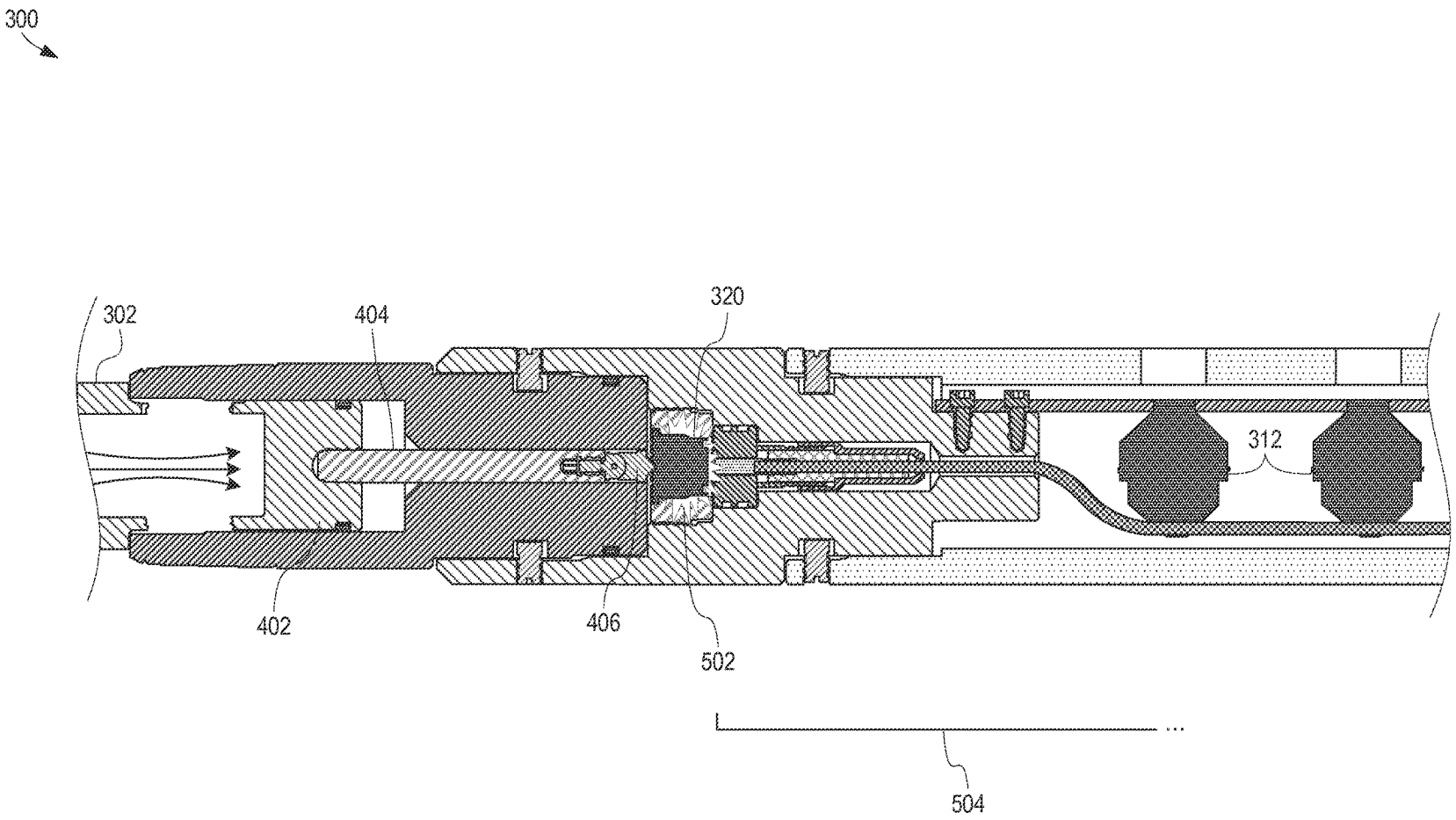
FIG. 5 is a partial cut-away view of the drill gun of FIGS. 3-4 at early detonation, according to certain aspects of the present disclosure.

FIG. 5 is a partial cut-away view of the drill gun 300 of FIGS. 3-4 at early detonation, according to certain aspects of the present disclosure. As seen, sufficient pressure has been introduced into the piston tubular 302 to shear the piston head 402 off, causing it to be pressed towards the detonation source 320. Moving the piston head 402 causes the piston rod 404 to force the firing pin 406 into the detonation source 320. Upon being struck by the firing pin 406, the detonation source 320 can generate a detonation 502, that can propagate through the detonation train 504 until it causes the detonation of one or more encapsulated charges 312.

As used herein, reference to the detonation train or any aspects of the detonation train being coupled to the detonation source or an encapsulated charge can include explosively coupling the components together such that detonation of one can induce detonation of another. Explosively coupling two components together can include positioning the components in sufficient proximity such that detonation of one can induce detonation of the other. In an example, the detonation train does not need to physically touch the detonation source in order to be coupled thereto, as long as detonation of the detonation source induces detonation of the detonation train.

The foregoing description of the embodiments, including illustrated embodiments, has been presented only for the purpose of illustration and description and is not intended to be exhaustive or limiting to the precise forms disclosed. Numerous modifications, adaptations, combinations and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is an assembly comprising a carrier having a length and an interior, the carrier made of a composite material; a plurality of encapsulated charges positioned within the interior of the carrier along the length of the carrier; a detonation housing coupled to the carrier, the detonation housing including a detonation source that is fluidly isolated from the interior of the carrier; and a detonation train coupling the detonation source to the plurality of encapsulated charges.

Example 2 is the assembly of example 1, wherein the carrier further includes a plurality of apertures aligned with the plurality of encapsulated charges.

Example 3 is the assembly of examples 1 or 2, wherein the detonation source is a percussion detonator positioned within an interior of the detonation housing.

Example 4 is the assembly of examples 1 or 2, wherein the detonation train includes a detonation cord passing into an interior of the detonation housing through a compression seal. Example 4 can also be the assembly of example 3, wherein the detonation train includes a detonation cord passing into the interior of the detonation housing through a compression seal.

Example 5 is the assembly of examples 3 or 4, wherein the detonation housing includes a shearable firing piston couplable to a tubular, the firing piston being positioned to displace a firing pin into the percussion detonator upon shearing.

Example 6 is the assembly of examples 1-5, wherein the plurality of encapsulated charges include a first set of encapsulated charges positioned radially out of phase from a second set of encapsulated charges.

Example 7 is the assembly of examples 1-6, wherein the carrier is made from a drillable composite material.

Example 8 is the assembly of examples 1-7, further comprising a downhole workstring coupled to the detonation housing.

Example 9 is a method comprising triggering a percussion detonator of a drill gun in a downhole environment to generate an explosion, the drill gun including: a carrier having an interior fluidly open to the downhole environment, the carrier being made of a composite material; a plurality of encapsulated charges within the interior of the carrier; a detonation housing coupled to the carrier and including the percussion detonator, the percussion detonator being fluidly isolated from the downhole environment; and a detonation train coupling the percussion detonator to the plurality of encapsulated charges. The method further including propagating successive additional explosions down the detonation train in response to generating the explosion at the percussion detonator; and detonating the plurality of encapsulated charges in response to propagating the successive additional explosions.

Example 10 is the method of example 9, wherein triggering the percussion detonator includes applying pressure to a shearable firing piston to shear off a head of the firing piston, the head of the firing piston coupled to a firing pin; and forcing the firing pin into the percussion detonator in response to shearing off the head of the firing piston.

Example 11 is the method of examples 9 or 10, wherein propagating the successive additional explosions includes detonating a booster in response to generating the explosion at the percussion detonator; and detonating a detonation cord in response to detonating the booster, wherein a portion of the detonation cord is positioned within the detonation housing through a compression seal.

Example 12 is the method of examples 9-11, wherein the carrier includes a plurality of apertures aligned with the plurality of encapsulated charges.

Example 13 is a system comprising a composite carrier positionable in a downhole environment, the composite carrier containing at least one encapsulated charge positioned within the interior of the composite carrier along a length of the composite carrier; a detonation housing coupled to the composite carrier, the detonation housing including a detonation source that is fluidly isolated from the downhole environment; and a detonation train coupling the detonation source to the at least one encapsulated charge.

Example 14 is the system of example 13, wherein the composite carrier further includes an aperture aligned with each of the at least one encapsulated charge.

Example 15 is the system of examples 13 or 14, wherein the detonation source is a percussion detonator.

Example 16 is the system of examples 13-15, wherein the detonation train includes a detonation cord coupled to the detonation housing by a sealed connection.

Example 17 is the system of examples 15 or 16, wherein the detonation housing includes a shearable firing piston couplable to a tubular, the firing piston being positioned to displace a firing pin into the percussion detonator upon shearing.

Example 18 is the system of examples 13-17, wherein the at least one encapsulated charge includes a first encapsulated charge positioned radially out of phase from a second encapsulated charge.

Example 19 is the system of examples 13-18, wherein the composite carrier is made from a drillable composite material.

Example 20 is the system of examples 13-19, further comprising a downhole workstring coupled to the detonation housing.

What is claimed is:

1. An assembly, comprising:

a carrier having a length and an interior, the carrier made of a composite material;

a plurality of encapsulated charges positioned within the interior of the carrier along the length of the carrier;

a detonation housing coupled to the carrier, the detonation housing including a detonation source that is entirely fluidly isolated from the interior of the carrier by a seal; and a detonation train coupling the detonation source to the plurality of encapsulated charges, wherein the detonation train includes a detonation cord passing into an interior of the detonation housing through the seal.

2. The assembly of claim 1, wherein the carrier further includes a plurality of apertures aligned with the plurality of encapsulated charges.

3. The assembly of claim 1, wherein the detonation source is a percussion detonator positioned within the interior of the detonation housing.

4. The assembly of claim 3, wherein the seal includes a compression seal.

5. The assembly of claim 3, wherein the detonation housing includes a shearable firing piston couplable to a tubular, the firing piston being positioned to displace a firing pin into the percussion detonator upon shearing.

6. The assembly of claim 1, wherein the plurality of encapsulated charges include a first set of encapsulated charges positioned radially out of phase from a second set of encapsulated charges.

7. The assembly of claim 1, wherein the carrier is made from a drillable composite material.

8. The assembly of claim 1, further comprising a downhole workstring coupled to the detonation housing.

9. A method, comprising:

triggering a percussion detonator of a drill gun in a downhole environment to generate an explosion, the drill gun including:

a carrier having an interior fluidly open to the downhole environment, the carrier being made of a composite material;

a plurality of encapsulated charges within the interior of the carrier;

a detonation housing coupled to the carrier and including the percussion detonator, the percussion detonator being entirely fluidly isolated from the downhole environment by a seal; and a detonation train coupling the percussion detonator to the plurality of encapsulated charges, wherein the detonation train includes a detonation cord passing into an interior of the detonation housing through the seal;

propagating successive additional explosions down the detonation train in response to generating the explosion at the percussion detonator; and detonating the plurality of encapsulated charges in response to propagating the successive additional explosions.

10. The method of claim 9, wherein triggering the percussion detonator includes:

applying pressure to a shearable firing piston to shear off a head of the firing piston, the head of the firing piston coupled to a firing pin; and forcing the firing pin into the percussion detonator in response to shearing off the head of the firing piston.

11. The method of claim 9, wherein propagating the successive additional explosions includes:

detonating a booster in response to generating the explosion at the percussion detonator; and detonating a detonation cord in response to detonating the booster, wherein a portion of the detonation cord is positioned within the detonation housing through a compression seal.

12. The method of claim 9, wherein the carrier includes a plurality of apertures aligned with the plurality of encapsulated charges.

13. A system, comprising:

a composite carrier positionable in a downhole environment, the composite carrier containing at least one encapsulated charge positioned within an interior of the composite carrier along a length of the composite carrier;

a detonation housing coupled to the composite carrier, the detonation housing including a detonation source that is entirely fluidly isolated from the downhole environment by a seal; and a detonation train coupling the detonation source to the at least one encapsulated charge, wherein the detonation train includes a detonation cord passing into an interior of the detonation housing through the seal.

14. The system of claim 13, wherein the composite carrier further includes an aperture aligned with each of the at least one encapsulated charge.

15. The system of claim 13, wherein the detonation source is a percussion detonator.

16. The system of claim 15, wherein the detonation housing includes a shearable firing piston couplable to a tubular, the firing piston being positioned to displace a firing pin into the percussion detonator upon shearing.

17. The system of claim 13, wherein the at least one encapsulated charge includes a first encapsulated charge positioned radially out of phase from a second encapsulated charge.

18. The system of claim 13, wherein the composite carrier is made from a drillable composite material.

19. The system of claim 13, further comprising a downhole workstring coupled to the detonation housing.

* * * * *